US005939248A

United States Patent [19]

Kirk et al.

[11] Patent Number: 5,939,248

[45] Date of Patent: Aug. 17, 1999

[54] PHOTOTHERMOGRAPHIC IMAGING MATERIALS AND ANTIFOGGANTS THEREFOR

[75] Inventors: Mark P. Kirk, Savona, Italy; David B. Oliff, Bishop's Stortford, United Kingdom

[73] Assignee: Minnesota Mining and Manufacturing Company, St. Paul, Minn.

[21] Appl. No.: 08/126,331

[22] Filed: Sep. 24, 1993

[30] Foreign Application Priority Data

Oct. 12, 1992 [GB] United Kingdom ..... 9221383

[51] Int. Cl.[6] ..... G03C 1/498

[52] U.S. Cl. ..... 430/619; 430/600; 430/607; 430/613; 430/615; 430/617

[58] Field of Search ..... 430/607, 619, 430/613, 615, 600, 617

[56] References Cited

U.S. PATENT DOCUMENTS 5,028,523 7/1991 Skoug ..... 430/607

FOREIGN PATENT DOCUMENTS 876734 7/1978 Belgium .

*Primary Examiner*—Thorl Chea

*Attorney, Agent, or Firm*—William K. Weimer

[57] ABSTRACT

A photothermographic material having a photosensitive medium comprising: photosensitive silver halide, a reducible silver source, a reducing agent for silver ion, a hydrobromic acid salt of a nitrogen-containing heterocyclic ring or fused ring nucleus associated with a pair of bromine atoms CHARACTERIZED IN THAT the photosensitive medium additionally comprises as an antifoggant, substantially in the absence of an antifoggant effective amount of mercury and other heavy metal salts, a tribromomethyl ketone compound of general formula (I):

(I)

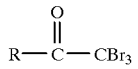

in which;

R represents an alkyl group, an aryl group, a carbocyclic ring or fused ring nucleus or a heterocyclic ring or fused ring nucleus.

16 Claims, No Drawings

PHOTOTHERMOGRAPHIC IMAGING MATERIALS AND ANTIFOGGANTS THEREFOR

FIELD OF THE INVENTION

This invention relates to photothermographic materials and in particular to the use therein of tribromomethyl ketone compounds of defined formula as antifoggants.

BACKGROUND TO THE INVENTION

Heat-developable silver halide photothermographic imaging materials, often referred to as "dry silver" compositions because no liquid development is necessary to produce the final image, are known and disclosed in, e.g., U.S. Pat. Nos. 3,152,904, 3,457,075, 3,839,049, 3,985,565, 4,022,617 and 4,460,681, and in "Thermally Processed Silver Systems" by D. Morgan and B. Shely, *Imaging Processes and Materials,* Neblette's Eighth Edition, Edited by Sturge et al., (1969). Such materials generally comprise: a light-insensitive, reducible silver source; a light-sensitive material which generates silver when irradiated, and a reducing agent for the silver source. The light-sensitive material is generally photographic silver halide which must be in catalytic proximity to the light-insensitive silver source. "Catalytic proximity" is defined as an intimate physical association of the two materials such that when silver specks or nuclei are generated by irradiation or light exposure of the photographic silver halide, those nuclei are able to catalyze the reduction of the silver source by the reducing agent. It has long been understood that silver is a catalyst for the reduction of silver ions and the silver-generating, light-sensitive silver halide catalyst progenitor may be placed into catalytic proximity with the silver source in a number of different fashions, such as partial metathesis of the silver source with a halogen-containing source (e.g., as disclosed in U.S. Pat. No. 3,457,075), coprecipitation of the silver halide and silver source material (e.g., as disclosed in U.S. Pat. No. 3,839,049) and any other method which intimately associates the silver halide and the silver source. Exposure of the silver halide to light produces small clusters of silver atoms. The imagewise distribution of these clusters is known in the art as the latent image. This latent image is generally not visible by ordinary means and the exposed material must be further processed in order to produce a visual image. Although stable at ambient temperatures, when heated after imagewise exposure to higher temperatures, silver is produced in the exposed regions of the medium through a redox reaction between the reducible silver source (acting as an oxidising agent) and the reducing agent. This redox reaction is accelerated by the catalytic action of the exposure generated silver atoms. The silver contrasts with the unexposed areas to form the image. Alternatively, the reducing agent may be such that it generates a colour on oxidation, either by becoming coloured itself, or by releasing a dye during the process of oxidation. The resulting colour image may optionally be diffused thermally to a separate receptor layer.

Photothermographic materials, like other light-sensitive systems, tend to suffer from fog. This spurious image density appears in the non-developmentally sensitized areas of the material and is often reported in sensitometric results as Dmin. This problem is also related to certain stability factors in the photosensitive material where fog increases upon storage. It is therefore customary to include an effective antifoggant in these materials.

In the past, the most effective antifoggant has been mercuric ion. The use of mercury compounds as antifoggants in photothermographic materials is disclosed in, e.g., U.S. Pat. No. 3,589,903. However, mercury compounds are environmentally undesirable and due to increasing pressure to remove even trace amounts of possible pollutants from commercial articles there is a demand to find equally effective but less hazardous antifoggants. Various compounds have been suggested for use as antifoggants in place of mercury compounds in photothermographic materials.

U.S. Pat. No. 4,546,075 discloses the use, in photothermographic media comprising an inorganic silver salt, a photocatalyst and a reducing agent, of compounds of the following general formulae as antifoggants in place of mercury compounds:

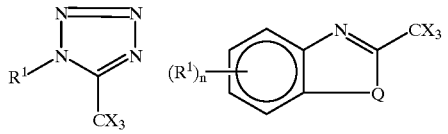

in which;

n has integral values of from 1 to 4,

Q represents S, O or $NR^2$, $R^1$ represents hydrogen or an alkyl, aryl, aralkyl, acyl, carbamoyl, alkylsulphonyl or arylsulphonyl group or a heterocyclic ring or fused ring nucleus, each $R^2$ independently represents an alkyl, aryl or acyl group, and X represents a halogen atom.

U.S. Pat. No. 4,546,075 also discloses the use of tribromoacetophenone as a comparative antifoggant when assessing the efficiency of the aforedescribed tetrazole, benzothiazole, benzoxazole and benzomidazole compounds. The results presented show that tribromoacetophenone has a negligible effect on the level of fog generated in the exemplified photothermographic system. For example, referring to Example 1, tribromoacetophenone achieves only minimal reduction on the level of fog observed in the control medium containing no antifoggant (a decrease in Dmin of from 0.69 to 0.55) when compared with the level of fog reduction achieved by the various tetrazole compounds etc., of the invention (Dmin of between 0.08 to 0.22 variously).

Japanese Patent Publication No. 59-57234 discloses, as antifoggants in place of mercury compounds, the use of compounds of the general formula:

$$R^1—CX_2—R^2$$

in which;

each X represents a halogen atom, preferably bromine, and $R^1$ and $R^2$ independently represent an acyl, oxycarbonyl, oxysulphonyl, alkylsulphonyl, arylsulphonyl, aralkylsulphonyl, carboxy, sulpho or sulphamoyl group, each of which may optionally be substituted.

U.S. Pat. No. 4,452,885 discloses, as antifoggants in place of mercury compounds, the use of compounds of the general formula:

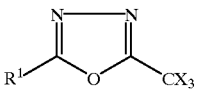

in which;

X represents a halogen atom, and $R^1$ represents hydrogen or an alkyl, aryl, aralkyl or alkenyl group or a heterocyclic ring or fused ring nucleus, each of which may be substituted.

European Patent Publication No. 223606 discloses, as antifoggants in place of mercury compounds, the use of compounds of the general formula:

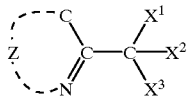

in which;

$X^1$ and $X^2$ independently represent halogen atoms, preferably bromine, $X^3$ represents a halogen atom, such as bromine or chlorine, preferably bromine, or an electron-withdrawing substituent, e.g., acyl, oxycarbonyl, oxysulphonyl etc., and Z represents the necessary atoms to complete an optionally substituted heterocyclic ring or fused ring nucleus.

Japanese Patent Publication No. 61-129642 discloses the use of halogenated compounds (including phenyl-(α,α-dibromobenzyl)-ketone to reduce fog in color-forming photothermographic emulsions.

U.S. Pat. No. 3,767,399, British Patent No. 1398265 and European Patent Publication No. 26859 disclose colour imaging systems in which organohalogen compounds, including tribromomethyl ketone compounds, are photolysed on exposure to light to produce a halogen radical which oxidises a colour-forming compound, e.g., an aldol naphthylamine, a leuco dye etc., to produce a coloured image.

European Patent Publication No. 061898 discloses the use of tribromomethyl ketone compounds as photoinitiators for a thermally developed imaging medium comprising a leuco dye, a nitrite ion and a sensitising dye.

Belgian Patent No. 876734 discloses the use of tribromomethyl ketone compounds to reduce the fog level in conventional, 'wet-processed' silver halide based imaging media, as well as claiming a speed enhancement.

Japanese Patent No. 61-93451 discloses aqueous silver halide/silver benzotriazole based imaging media incorporating water-soluble sensitising dyes and other conventional photographic additives. The imaged material is not thermally processed, but 'fixed' by contact with another coating to which the dye image is transfered. Certain tribromomethyl ketone compounds are disclosed as antifoggants for use therein.

French Patent Nos. 2483092 and 2483637 and British Patent Nos. 2076552 and 2076984 disclose silver iodide based photothermographic media of the post-activation type, i.e., requiring thermal activation prior to imaging, incorporating as antifoggants an oxidising agent for free silver and a photo-reactive organohalogen oxidising agent comprising a halogenated organic compound having one or more bromine-carbon or iodine-carbon linkages. The preferred organohalogen oxidising agent is o-tetrabromoxylene, although a number of tribromomethyl ketone compounds are exemplified. The free silver oxidising agent, usually mercuric ion, although palladium and cobalt are also exemplified, is the primary antifoggant with the organohalogen oxidising agent functioning in a secondary role to regenerate the reduced free silver oxidising agent.

Tribromomethyl ketone compounds have now been found to be effective antifoggants in photothermographic materials of the type disclosed in U.S. Pat. No. 5,028,523, which contain, in addition to the usual photothermographic chemistry, a hydrobromic acid salt of a nitrogen-containing heterocyclic ring or fused ring nucleus associated with a pair of bromine atoms, as a speed enhancing agent/antifoggant.

BRIEF SUMMARY OF THE INVENTION

According to the present invention there is provided a photothermographic material having a photosensitive medium comprising: photosensitive silver halide, a reducible silver source, a reducing agent for silver ion, a hydrobromic acid salt of a nitrogen-containing heterocyclic ring or fused ring nucleus associated with a pair of bromine atoms, and as an antifoggant, substantially in the absence of an antifoggant effective amount of mercury and other heavy metal salts, a tribromomethyl ketone compound of general formula (I):

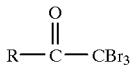

(I)

in which;

R represents an alkyl group, an aryl group, a carbocyclic ring or fused ring nucleus or a heterocyclic ring or fused ring nucleus.

The compounds of formula (I) represent a class of tribromomethyl ketone compounds which have been found to be effective antifoggants in photothermographic materials, reducing fog to the same or a greater extent than conventional mercury-containing antifoggants. There is also evidence to suggest that the compounds of formula (I) are able to improve the image stability both before, during and after processing when compared with formulations containing mercury-containing antifoggants.

As is well understood in this technical area, a large degree of substitution is not only tolerated, but is often advisable. As a means of simplifying the discussion, the terms "nucleus", "groups" and "moiety" are used to differentiate between chemical species that allow for substitution or which may be substituted and those which do not or may not be so substituted. For example, the phrase "alkyl group" is intended to include not only pure hydrocarbon alkyl chains, such as methyl, ethyl, octyl, cyclohexyl, iso-octyl, t-butyl and the like, but also alkyl chains bearing conventional substituents known in the art, such as hydroxyl, alkoxy, phenyl, halogen (F, Cl, Br and I), cyano, nitro, amino etc. The term "nucleus" is likewise considered to allow for substitution. Thus, the phrase "pyrimidine nucleus" would be understood to include not only an unsubstituted pyrimidine ring, but also pyrimidine rings bearing conventional substituents known in the art. The phrase "alkyl moiety" on the other hand is limited to the inclusion of only pure hydrocarbon alkyl chains, such as methyl, ethyl, propyl, cyclohexyl, iso-octyl, t-butyl and the like.

DESCRIPTION OF THE PREFERRED EMBODIMENTS

Referring to formula (I), groups represented by R are generally selected from alkyl groups comprising up to 10 carbon atoms, preferably up to 5 carbon atoms; aryl groups comprising up to 14 carbon atoms, preferably up to 10 carbon atoms; 5, 6, 7 or 8-membered carbocyclic ring nuclei; carbocyclic fused ring nuclei comprising up to 14 carbon atoms; 5, 6, 7 or 8-membered heterocyclic ring nuclei and heterocyclic fused ring nuclei comprising up to 14 ring atoms, each of which groups, ring and fused ring nuclei may possess one or more substituents selected from alkyl groups (e.g., methyl, ethyl, isopropyl etc.), halogen atoms (e.g., fluorine, chlorine, bromine and iodine), a hydroxy group, alkoxy groups (e.g., methoxy, ethoxy etc.), aryloxy groups (e.g., phenoxy, hydroxyphenoxy etc.), amino groups (e.g., amino, methylamino, dimethylamino etc.), a cyano group, acylamino groups (e.g., acetylamino, benzoylamino etc.), diacylamino groups (e.g., succinimido etc.), ureido groups (e.g., methylureido etc.), sulphonamido groups (e.g., methylsulphonamide etc.), acyloxy groups (e.g., acetyloxy etc.), sulphamoyl groups (e.g., N-ethylsulphamoyl etc.), alkylcarbonyl groups, arylcarbonyl groups, alkoxycarbonyl groups (e.g., methoxycarbonyl, ethoxycarbonyl etc.), aryloxycarbonyl groups (e.g., phenoxycarbonyl etc.), alkoxycarbonyl amino groups (e.g., ethoxycarbonylamino etc.), aryl groups (e.g., phenyl, tolyl etc.), hydroxyalkyl groups (e.g., hydroxyethyl, hydroxypropyl etc.), alkoxyalkyl groups (e.g., methoxyethyl, methoxypropyl etc.), mercapto groups, alkylthio groups, arylthio groups, alkylsulphonyl groups, arylsulphonyl groups, acyl groups, aralkyl groups, alkyl groups containing a carboxyl group (e.g., carboxymethyl, carboxyethyl etc.), each of which groups may where appropriate comprise up to 14 carbon atoms, preferably not more than 10 carbon atoms.

Examples of ring and fused ring nuclei represented by R include: isoxazole, pyrimidine, quinoxaline, indolenine and tetraazindene.

Examples of alkyl groups represented by R include: methyl, ethyl, propyl, isopropyl, butyl, isobutyl, t-butyl, pentyl, isopentyl, hexyl, octyl etc.

Examples of aryl groups represented by R include: phenyl, ethoxyphenyl, tolyl, xylyl, naphthyl etc.

Preferred compounds within the scope of formula (I) comprise in the present invention comprise a nucleus represented by one of formulae (II) to (V):

(II)

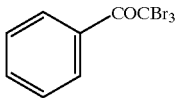

(III)

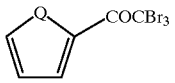

(IV)

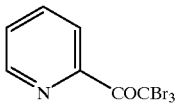

(V)

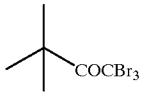

in which;

Q represents O, S or $NR^1$ where $R^1$ represents hydrogen or an alkyl group comprising up to 5 carbon atoms, e.g., methyl. Each of the above nuclei may optionally possess one or more substituents selected from those defined for groups represented by R.

Preferred compounds within the scope of formulae (II) to (IV) comprise a nucleus represented by one of the following:

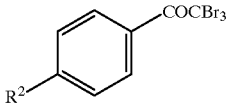

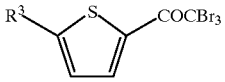

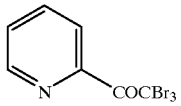

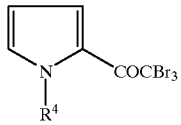

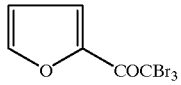

in which;

$R^2$ is hydrogen, an alkyl or alkoxy group, generally comprising up to 10 carbon atoms, preferably not more than 5 carbon atoms, an aryl group, generally comprising up to 10 ring atoms, preferably a phenyl group, a cyano group or —C(O)—$CX_3$ where X is halogen, e.g., Cl, Br etc.;

$R^3$ is hydrogen, halogen or a cyano group, and $R^4$ is hydrogen or an alkyl group, generally comprising up to 10 carbon atoms, preferably not more than 5 carbon atoms.

Conventional silver halide phothothermographic chemistry is used in the materials of the invention. Such chemistry is described in, e.g., U.S. Pat. Nos. 3,457,075, 3,839,049, 3,985,565, 4,022,617 and 4,460,681. Any of the various photothermographic media, such as full soaps, partial soaps, full salts, and the like may be used in the practice of the present invention, including both black-and-white and color chemistries and either in situ halidised (e.g., as disclosed in U.S. Pat. No. 3,457,075) or preformed silver halide sources (e.g., as disclosed in U.S. Pat. No. 3,839,049) may be used.

Conventional photothermographic chemistry comprises a photosensitive silver halide catalyst, a silver compound capable of being reduced to form a metallic silver image (e.g., silver salts, both organic and inorganic, and silver complexes, usually light-insensitive silver materials), a developing agent for silver ion (a mild reducing agent for silver ion) and a binder. Colour photothermographic systems additionally have a leuco dye or dye-forming developer (alone or in combination with a developer for silver ion), or a colour photographic coupler which would require a colour photographic developer to be used as the developing agent for silver ion. Thus, both negative and positive systems can be used.

The compounds of formula (I) may be incorporated into the photothermographic medium in the same manner as antifoggants of the prior art. The optimum concentration for individual compounds of formula (I) may vary widely. In some cases, starting from the minimum amount required to suppress fog, increasing the amount of the tribromomethyl ketone compound leads to a loss of image density, but in other cases it may produce an increase in image density before levelling out. In general, the compounds of formula (I) are utilised in amounts of from about $1\times10^{-3}$ to about $1\times10^{-1}$ moles per mole of silver, although amounts outside this range may also be useful.

The compounds of formula (I) may be readily prepared by tribromination of the corresponding substituted heterocycles. The precursor compounds may be readily prepared by standard synthetic procedures well known in the art.

The following TABLE 1 identifies specific examples of tribromomethyl ketone compounds compounds suitable for use in the present invention.

TABLE 1

| COMPOUND | STRUCTURAL FORMULA |
|---|---|
| 1–6 | 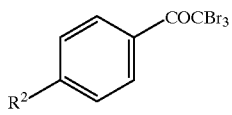 1 $R^2$ = —$OCH_3$<br>2 $R^2$ = —$NO_2$<br>3 $R^2$ = —CN<br>4 $R^2$ = H<br>5 $R^2$ = —C(=O)—$CBr_3$<br>6 $R^2$ = —$C_6H_5$ |
| 8–11 | 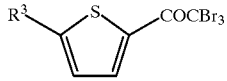 8 $R^3$ = —H<br>9 $R^3$ = —Cl<br>10 $R^3$ = —Br<br>11 $R^3$ = —CN |
| 12 | 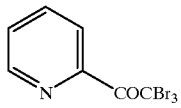 |
| 13–14 | 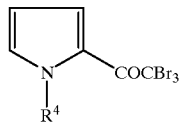 13 $R^4$ = —H<br>14 $R^4$ = —$CH_3$ |
| 15 | 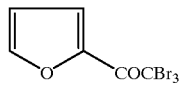 |
| 16 | 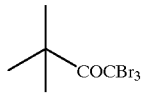 |

In addition to the tribromomethyl ketone compounds of formula (I), the photothermographic media of the invention also contain, as a speed enhancing agent/antifoggant, a heterocyclic ring compound in which a nitrogen atom of the ring is electrically balanced by hydrobromic acid and is associated with a pair of bromine atoms, as described in U.S. Pat. No. 5,028,523. The term "association" means non-covalent chemical or electrical association of the bromine atoms. The central nucleus of the nitrogen-containing heterocyclic compound may be generally represented by any of the following formulae:

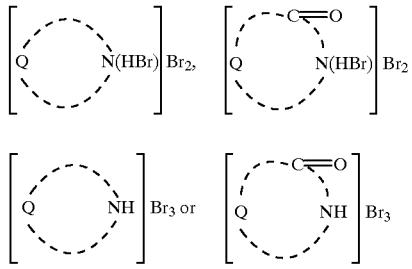

in which;

Q represents the atoms (preferably selected from C, S, N, Se and O, more preferably C, N and O) necessary to complete a 5, 6, or 7-membered heterocyclic ring (monocyclic) or fused ring nucleus (polycyclic, especially bicyclic, with a fused-on benzene ring). The heterocyclic nucleus may possess one or more substituents selected from those defined for groups represented by R. Exemplary and preferred heterocyclic ring groups include pyridine, pyrolidone and pyrrolidinone. Other useful heterocyclic ring nuclei include pyrocyclic rings, e.g., pyrrolidines, phthalazinone, phthalazine etc.

Preferred heterocyclic nuclei for use in the practice of the present invention may be defined by the formulae:

(i)

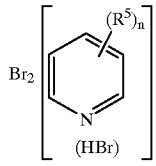

(ii)

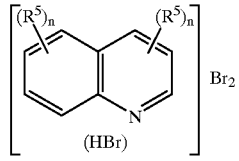

(iii)

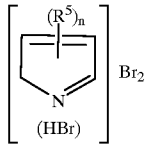

(iv)

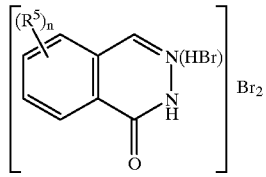

-continued (v)

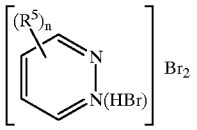

(vi)

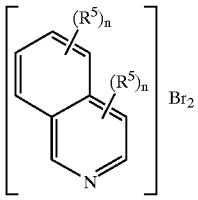

(vii)

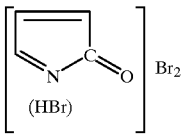

(viii)

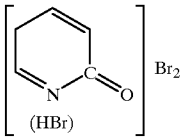

in which;

n is 0 (zero) or has integral values of from 1 to 4, and each $R^5$ represents a substituent selected from those defined for groups represented by R, e.g., alkyl groups, alkoxy groups, aryl groups, nitro, cyano, and the like. Substituents on adjacent positions may form fused ring groups so that formula (i) above would in fact be inclusive of formulae (ii) and (iv).

These compounds are generally used in an amount of at least 0.005 moles/mole of silver. Usually the range is from 0.005 to 1.0 moles of the compound per mole of silver and preferably between 0.01 and 0.3 moles per mole of silver. The preferred level is currently about 0.01 moles/mole silver.

The preferred nitrogen-containing heterocyclic compound is pyridinium hydrobromide perbromide (PHP).

Photothermographic materials are usually constructed as one or two imaging layers on a substrate. Single layer contructions must contain the reducible silver source, the silver halide and the developer, as well as optional additional materials, such as toners, coating aids and other adjuvants. Two-layer constructions must contain the reducible silver source and silver halide in one layer (usually the layer adjacent the substrate) and the other ingredients in the second layer or both layers.

The silver halide may be any photosensitive silver halide, such as silver chloride, silver bromide, silver iodide, silver chlorobromide, silver bromoiodide, silver chlorobromoiodide etc., and may be added to the imaging layer in any fashion which places it in catalytic proximity to the reducible silver source. The silver halide generally comprises from 0.75 to 15% by weight of the imaging layer, although larger amounts of up to about 25% by weight, are also useful. It is preferred to use from 1 to 10% by weight silver halide in the layer, more preferably from 1.5 to 7%. The silver halide may be prepared in situ by conversion of a portion of silver soap by reaction with halide ions or it may be preformed and added during soap generation, or a combination of these methods may be used. The latter is preferred.

The reducible silver source may comprise any material which contains a reducible source of silver ions. Silver salts of organic and hetero-organic acids, particularly long chain fatty carboxylic acids (comprising from 10 to 30, preferably 15 to 25 carbon atoms), are preferred. Complexes of organic or inorganic silver salts in which the ligand has a gross stability constant for silver ion of between 4.0 and 10.0 are also useful.

Examples of suitable silver salts are disclosed in Research Disclosure Nos. 17029 and 29963 and include: salts of organic acids, e.g., gallic acid, oxalic acid behenic acid, stearic acid, palmitic acid, lauric acid and the like; silver carboxyalkylthiourea salts, e.g., 1-(3-carboxypropyl) thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicylic acid, benzilic acid, 3,5-dihydroxybenzilic acid and 5,5-thiodisalicylic acid, silver salts or complexes of thiones, e.g., 3-(2-carboxyethyl)-4-hydroxymethyl-4-thiazoline-2-thione and 3-carboxymethyl-4-thiazoline-2-thione complexes or salts of silver with nitrogen acids selected from imidazole, pyrazole, urazole, 1,2,4-triazole and 1H-tetrazole, 3-amino-5-benzylthio-1,2,4-triazole and benzotriazole; silver salts of saccharin, 5-chlorosalicylaldoxime and the like; and silver salts of mercaptides.

The preferred silver source is silver behenate.

The reducible silver source generally comprises from 5 to 70%, preferably from 7 to 45% by weight of the imaging layer. The use of a second imaging layer in a two-layer construction does not affect the percentage of the silver source.

The reducing agent for silver ion may be any material, although organic materials are preferred which will reduce silver ion to metallic silver. Conventional photographic developers such as phenidone, hydroquinones and catechol are useful, but hindered phenol reducing agents are preferred. The reducing agent generally comprises from 1 to 10% by weight of the imaging layer, but in a two-layer construction, if the reducing agent is in the layer separate from that containing the reducible silver source, slightly higher proportions, e.g., from 2 to 15%, tend to be more desirable. Colour photothermographic materials, such as those disclosed in U.S. Pat. No. 4,460,681, are also contemplated in the practice of the present invention.

Examples of suitable reducing agents are disclosed in U.S. Pat. Nos. 3,770,448, 3,773,512 and 3,593,863 and Research Disclosure Nos. 17029 and 29963, and include aminohydroxycycloalkenone compounds, e.g., 2-hydroxypiperidino-2-cyclohexenone; esters of amino reductones as developing agent precursors, e.g., piperidino hexose reductone monoacetate; N-hydroxyurea derivatives, e.g., N-p-methylphenyl-N-hydroxyurea; hydrazones of aldehydes and ketones, e.g., anthracene aldehyde phenylhydrazone; phosphoramidophenols; phosphoramidoanilines; polyhydroxybenzenes, e.g., hydroquinone, t-butylhydroquinone, isopropylhydroquinone and (2,5-dihydroxyphenyl)methylsulfone; sulfhydroxamic acids, e.g., benzenesulfhydroxamic acid; sulfonamidoanilines, e.g., 4-(N-methanesulfonamido)aniline;

2-tetrazolylthiohydroquinones, e.g., 2-methyl-5-(1-phenyl-5-tetrazolylthio)hydroquinone; tetrahydroquinoxalones, e.g., 1,2,3,4,-tetrahydroquinoxaline; amidoxines; azines, e.g., a combination of aliphatic carboxylic acid aryl hydrazides and ascorbic acid; a combination of a polyhydroxybenzene and a hydroxylamine, a reductone and/or a hydrazine; hydroxamic acids; a combination of azines and sulfonamidophenols; α-cyanophenylacetic acid derivatives; a combination of a bis-β-naphthol and a 1,3-dihydroxybenzene derivative; 5-pyrazolones; sulfonamidophenol reducing agents; 2-phenylindane-1,3-dione and the like; chromans; 1,4-dihydropyridines, such as 2,6-dimethoxy-3,5-dicarbethoxy-1,4-dihydropyridine; bisphenols, e.g., bis(2-hydroxy-3-t-butyl-5-methylphenyl) methane, bis(6-hydroxy-m-toly) mesitol, 2,2-bis(4-hydroxy-3-methylphenyl)propane, 4,4-ethylidene-bis(2-t-butyl-6-methylphenol, UV-sensitive ascorbic acid derivatives and 3-pyrazolidones.

The preferred developers are hindered phenols of the general formula:

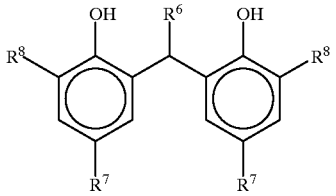

in which;

$R^6$ represents hydrogen or an alkyl group generally comprising up to 10 carbon atoms, e.g., butyl, and $R^7$ and $R^8$ represent alkyl groups of up to 5 carbon atoms, e.g., methyl, ethyl, t-butyl etc.

The presence of a toner (sometimes referred to as a "tone modifier") is not essential, but is highly preferred. Examples of suitable toners are disclosed in Research Disclosure No. 17029 and include: imides, e.g., phthalimide; cyclic imides, pyrazolin-5-ones and a quinazolinone, such as succinimide, 3-phenyl-2-pyrazolin-5-one, 1-phenylurazole, quinazoline and 2,4-thiazolidinedione; naphthalimides, e.g., N-hydroxy-1,8-naphthalimide; cobalt complexes, e.g., cobaltic hexammine trifluoroacetate, mercaptans, e.g., 3-mercapto-1,2,4-triazole; N-(aminomethyl)aryl dicarboximides, e.g., N-(dimethylaminomethyl)phthalimide; a combination of blocked pyrazoles, isothiuronium derivatives and certain photobleach agents, e.g., a combination of N,N'-hexamethylene bis(1-carbamoyl-3,5-dimethylpyrazole), 1,8-(3,6-dioxaoctane)bis(isothiuronium trifluoroacetate) and 2-(tribromomethylsulfonyl) benzothiazole); merocyanine dyes, such as 3-ethyl-5-[(3-ethyl-2-benzothiazolinylidene)-1-methylethylidene]-2-thio-2,4-oxazolidinedione; phthalazinone, phthalazinone derivatives or metal salts of these derivatives, such as 4-(1-naphthyl)phthalazinone, 6-chlorophthalazinone, 5,7-dimethoxyphthalazinone and 2,3-dihydro-1,4-phthalazinedione; a combination of phthalazinone and a sulfinic acid derivative, e.g., 6-chlorophthalazinone plus sodium benzene sulfinate or 8-methylphthalazinone plus sodium p-tolysulfinate; a combination of phthalazinone plus phthalic acid; a combination of phthalazine including an adduct of phthalazine and maleic anhydride) and at least one compound selected from phthalic acid, a 2,3-naphthalene dicarboxylic acid or an o-phenylene acid derivative and anhydrides thereof, e.g., phthalic acid, 4-methylphthalic acid, 4-nitrophthalic acid and tetrachlorophthalic anhydride; quinazolinediones, benzoxazine and naphthoxazine derivatives; benzoxazine-2,4-diones, e.g., 1,3-benzoxazine-2,4-dione; pyrimidines and asym-triazines, e.g., 2,4-dihydroxypyrimidine, and tetraazapentalene derivatives, e.g., 3,6-dimercapto-1,4-diphenyl-1H,4H-2,3a,5,6a-tetraazapentalene.

Preferred toners are phthalazinone, phthalazine and phthalic acid, acid, either alone or in combination with other compounds.

The toner, when present, is generally included in an amount of from 0.2 to 12%, preferably 0.2 to 5% by weight of the imaging layer.

The photothermographic chemistry may be black and white or colour-forming. In the latter type of material, the reducing agent generates a colour on oxidation, either by becoming coloured itself, or by releasing a dye during the process of oxidation. Any leuco dye capable of being oxidized by silver ion to form a visible dye is useful in the practice of the present invention. Dye-forming developers such as those disclosed in U.S. Pat. Nos. 3,445,234, 4,021,250, 4,022,617 and 4,368,247 are useful, particularly those disclosed in Japanese Patent Publication No. 82-500352.

The photothermographic chemistry is typically applied to the support in a binder. A wide range of binders may be employed in the imaging layer(s), including both natural and synthetic resins. Copolymers and terpolymers are of course included. Suitable binders are transparent or translucent, are generally colourless and include natural polymers, synthetic resins, polymers and copolymers and other film forming media such as: gelatin; gum arabic; poly(vinyl alcohol); cellulose esters, such as hydroxyethyl cellulose, cellulose acetate, cellulose acetate butyrate; poly(vinyl pyrrolidone); casein; starch; poly(acrylic acid), poly(methylmethacrylic acid), poly(methacrylic acid); poly(vinyl chloride); copoly(styrene-maleic anhydride), copoly(styrene-acrylonitrile), copoly(styrene-butadiene); polyacrylonitrile; polyvinyl acetals, such as, poly(vinyl formal) and poly(vinyl butyral); polyesters; polyurethanes; phenoxy resins; poly(vinylidene chloride); polyepoxides; polycarbonates; poly(vinyl acetate); polyolefins, such as poly(ethylene) and poly(propylene), and polyamides. Poly(vinyl acetals), such as poly(vinyl butyral) and poly(vinyl formal), and vinyl copolymers, such as poly(vinyl acetate-chloride) are particularly desirable. The binders are generally used in an amount ranging from 20 to 75% by weight, preferably from 30 to 55% by weight of the silver halide containing layer. The binders may be coated from aqueous or organic solvents or an emulsion.

The photothermographic elements of the invention are prepared by simply coating a suitable support or substrate with the one or more imaging layers containing the photothermographic chemistry and, optionally, a oxygen-barrier overlayer. Suitable barrier layers are well known in the art. Each layer is generally coated from a suitable solvent using techniques known in the art. Exemplary supports include materials, such as paper, polyethylene-coated paper, polypropylene-coated paper, parchment, cloth and the like; sheets and foils of metals, such as aluminium, copper, magnesium and zinc; glass and glass coated with metals such as chromium alloys, steel, silver, gold and platinum; synthetic polymeric materials, such as poly(alkyl methacrylates), e.g., poly(methyl methacrylate), polyesters, e.g., poly(ethylene terephthalate) and poly(ethylene naphthalate), poly(vinyl acetals), polyamides, e.g., nylon, cellulose esters, e.g., cellulose nitrate, cellulose acetate, cellulose acetate propionate, cellulose acetate butyrate, and the like.

Various other adjuvants may be added to the photothermographic medium. For example, accelerators, acutance dyes, sensitizers, stabilizers, plasticizers, surfactants, lubricants, coating aids, antifoggants, leuco dyes, chelating agents, binder crosslinking agents, UV-absorbers and various other well-known additives may be usefully incorporated in the medium. The use of acutance dyes matched to the spectral emission of the exposing source is particularly desirable. It is not essential for the photothermographic elements of the invention to comprise a separate support since each binder layer, together with the photothermographic chemistry may be cast to form a self-supporting film.

The supports can be sub-coated with known subbing materials such as: copolymers and terpolymers of vinylidene chloride, and acrylic monomers, such as acrylonitrile and methyl acrylate; unsaturated dicarboxylic acids, such as itaconic or acrylic acid; carboxymethyl cellulose; polyacrylamide, and similar polymeric materials.

The support can also carry a filter or antihalation layer, such as one comprising a dyed polymer layer, which absorbs the exposing radiation after it passes through the radiation-sensitive layer and eliminates unwanted reflection from the support.

The invention will now be described by way of example with reference to the accompanying non-limiting Examples in which Compounds 4,6,7,9 and 15 are as shown in TABLE 1 and Compound A is a comparative, non-mercury antifoggant disclosed in British Patent Publication No. 2076552.

Compound A

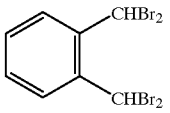

EXAMPLE 1

The synthesis of the compounds of formula (I) is exemplified with reference to the synthesis protocol for Compound 4 (tribromomethyl phenyl ketone) from TABLE 1.

A three necked round bottomed flask (500 ml) was fitted with a double surface water cooled condenser, a thermometer (10 to 200° C.) in contact with the reaction surface and a pressure equilibrating dropping funnel (100 ml). The flask was suspended in a thermostatically controlled silicone oil bath and charged with a magnetic stirrer bar, acetophenone (11.6 ml; 0.1 mol), anhydrous sodium acetate (49.27 g; 0.6 mol) and glacial acetic acid (200 ml). The temperature of the oil bath was then raised to 130° C. (266° F.) and the reaction flask allowed to equilibrate to that temperature. The dropping funnel was charged with bromine (15.5 ml; 0.3 mol) and acetic acid (50 ml) which was then added to the reaction mixture while maintaining a gentle reflux. The bromine colour was discharged instantaneously. The reaction mixture was then heated for a further 10 minutes before removing the flask from the oil bath and allowing it to cool to room temperature. The resulting slurry was poured into ice/water mixture (1500 ml) and stirred vigorously for one hour. A white precipitate was filtered off, air dried and then recrystallised from acetonitrile to yield white crystals of tribromomethyl phenyl ketone [19.2 g; Yield=53%; m.p.=63 to 64° C. (145 to 147° F.)]. $^{1}H$ and $^{13}C$ nmr was used to confirm the structural assignment.

EXAMPLE 2

Colour photothermographic elements were prepared by adding Compound 15 (0.3 g) from TABLE 1 (Element 1) and mercuric bromide ($HgBr_2$; Element 2) to successive mixtures of Formulations A and B (13.5 g and 6.0 g respectively). The resulting mixtures (with antifoggant) were coated on a commercial film base (7 mm thick) at 50 μm (2 mil) wet thickness and overcoated with Formulation D at a wet thickness of 50 μm (2 mil). Control elements were also prepared without any antifoggant. Each element was dried in an oven at 70° C. (160° F.) for 210 seconds.

Once dry, samples of the material were imaged and developed at 121° C. for 6 seconds. The sensitometric results obtained are presented in TABLE 2.

Formulation A

Developer solution was prepared with the following ingredients, each added in its listed order with mixing:

| | |
|---|---|
| 1. ethyl ketazine | 0.9 g |
| 2. phthalazine | 1.8 g |
| 3. tetrahydrofuran | 80.0 g |
| 4. VAGH (a hydroxyl-modified vinyl acetate-vinyl chloride copolymer commercially available from Union Carbide) | 4.5 g |
| 5. BUTVAR B-76 (poly(vinyl butyral) commercially available from Monsanto) | 6.8 g |

Formulation B

Spectrally sensitised silver soap: Dye I (0.042 g) was dissolved in methanol (20 ml). The dye solution (5 ml) was added to the silver soap stock solution (Formulation C; 80 ml).

DYE I

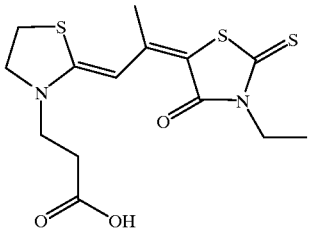

Formulation C

Silver soap stock solution: a preformed silver soap (silver bromide; 0.055 μm grain size) was prepared as follows:

I. INGREDIENTS

1. AgBr (115 g at 523 g/mole) in $H_2O$ (1250 ml)
2. NaOH (89.18 g) in $H_2O$ (1500 ml)
3. $AgNO_3$ (364.8 g) in $H_2O$ (2500 ml)
4. Fatty acid (131 g); Humko Type 9718)
5. Fatty acid 634.5 g; Humko Type 9022)
6. $HNO_3$ (19 ml) in $H_2O$ (50 ml)

II REACTION

1. Dissolve #4 and #5 at 80° C. (176° F.) in 13 liters of water and mix for 15 minutes.
2. Add #1 to solution at 80° C. and mix for 10 minutes to form a dispersion.
3. Add #2 to the dispersion at 80° C. and mix for 5 minutes.
4. Add #6 to dispersion at 80° C. and mix for 25 minutes.

5. Add #3 to dispersion at 35° C. (95° F.) and hold at 55° C. (131° F.) for 2 hours.
6. Wash until wash water is 20,000 Ω/cm$^2$
7. Dry.

Pyridinium hydrobromide perbromide (3×0.055 g) was added to a mixture of the preformed silver soap (200 g) and poly(vinyl butyral) (32 g; commercially available from Monsanto under the trade name BUTVAR B-76) in methylethyl ketone (40 g) over a period of 1 hour. The mixture was left to stand for 5 hours before addition of calcium bromide (10% solution in methanol; 1 to 3 ml). This mixture was held for 24 hours at 28° C. (50° F.).

Formulation D

Topcoat: poly(styrene) (18 g) in a mixture of acetone (111 g) methylethyl ketone (55 g) and toluene (22 g).

TABLE 2

| Element | Compound | Dmin | Dmax | Speed | Contrast |
|---|---|---|---|---|---|
| CONTROL | — | 2.20 | 2.20 | — | — |
| 1 | 15 | 0.09 | 2.18 | 1.64 | 2.41 |

The stability of the imaged materials was investigated by storing imaged samples of Photothermographic Elements 1 and 2 at 1076.4 1× (100 fc), 50% relative humidity and 21° C. (70° F.) for 9 days. The results obtained are shown in TABLE 3 in terms of conventional LAB colour coordinate values.

TABLE 3

| Element* | Compound | ΔR | ΔG | ΔB | Fade % |
|---|---|---|---|---|---|
| 1 | 15 | 0.02 | 0.08 | 0.07 | 10 |
| 2(c) | $HgBr_2$ | — | 0.13 | 0.18 | 27 |

*(c) = comparative element not in accordance with the invention

The above results show that the tribromomethyl compounds of formula (I) can, in the absence of mercuric and other heavy metal salts, reduce the level of fog in materials designed to yield coloured images, as well as confering image stability to ambient light conditions.

EXAMPLE 3

A series of black & white photothermographic elements were prepared by coating Formulation E at a 175 μm (7 mil) wet thickness onto conventional photographic base (paper or film) and drying the coated layer at 70° C. (158° F.) for 240 seconds. Formulation F was coated on top of the dried underlayer at a 100 μm (4 mil) wet thickness and dried at 70° C. for 240 seconds.

Once dry, samples of the materials were imaged. The sensitometric results obtained are presented in TABLE 4.

Formulation E

Silver soap underlayer: the following ingredients were added to a preformed full soap homogenate (100 g) comprising equal parts by weight of (a) silver behenate Full soap, and (b) a preformed silver behenate Full soap prepared in accordance with the method described in Example 1 of U.S. Pat. No. 5,028,523, but in which the silver halide was a 50:50 mixture of silver iodobromide (0.05 μm grain size) and silver iodobromide (0.07 μm grain size) with stirring as indicated:

1. methylethyl ketone (50 ml) stirring for 5 minutes.
2. BUTVAR B-76 (33.1 g) stirring for 25 minutes.
3. Pyridinium hydrobromide perbromide (3×0.06 g) in methanol (5 ml) stirring for 2 hours.
4. Calcium bromide (10% solution in methanol; 1 to 3 ml) stirring for 30 minutes.

All operations were carried out in a minus blue light environment (normally a Red 1A Safelight area) and at a temperature of 7° C. (45° F.) unless otherwise indicated.

The resulting mixture was stored overnight in a sealed container before warming to 21° C. (70° F.) and adding the following ingredients with stirring as indicated:

1. NONOX (developer: 1,1-bis(2-hydroxy-3,5-dimethylpenyl)-3,5,5-trimethylhexane; 7 g).
2. 2-(4-chlorobenzoyl)benzoic acid (12% solution in methanol; 10 ml) stirring for 30 minutes.
3. 2-mercaptobenzimidazole (0.5% solution in methanol; 6.4 ml) stirring for 15 minutes.
4. Dye II (0.2% solution in dimethyl formamide; 3.7 ml) stirring for 15 minutes.

DYES II

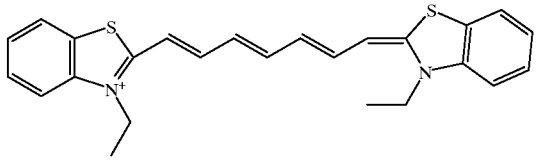

Solution F

Topcoat: the following ingredients were mixed in an ultrasonic bath until a clear solution was obtained:

| | |
|---|---|
| 1. acetone | 140 ml |
| 2. methylethyl ketone | 67 ml |
| 3. methanol | 27.5 ml |
| 4. cellulose acetate (398-6) | 9.0 g |
| 5. phthalazine | 1.0 g |
| 6. 4-methylphthalic acid | 0.72 g |
| 7. tetrachlorophthalic acid | 0.22 g |
| 8. tetrachlorophthalic anhydride | 0.50 g |
| 9. Compound 4,6,7,9,15 or A or $HgBr_2$ | [1]0.2, 0.5 or 1.0 g |

The resulting mixture was allowed to stand for 1 hour at 21° C. (70° F.) before use.

TABLE 4

| Element | Compound | Quantity (g) | Dmin | Dmax | Speed | Contrast |
|---|---|---|---|---|---|---|
| Control | — | — | 0.78 | 1.76 | 2.19 | 4.50 |
| 3(c) | $HgBr_2$ | 0.2 | 0.12 | 1.70 | 1.78 | 1.95 |
| 4(c) | A | 0.2 | 0.40 | 1.74 | 2.04 | 1.27 |
| 5(c) | A | 0.5 | 0.25 | 1.73 | 1.98 | — |
| 6(c) | A | 1.0 | 0.44 | 1.70 | 1.80 | 1.15 |
| 7 | 4 | 0.2 | 0.14 | 1.59 | 2.00 | 1.17 |
| 8 | 4 | 0.5 | 0.17 | 1.76 | 1.80 | 2.25 |
| 9 | 4 | 1.0 | 0.14 | 1.70 | 1.82 | 2.54 |

(c) = comparative element not in accordance with the invention.

It can be seen from the above data that compounds of formula (I) can in the absence of mercuric and other heavy metal salts reduce the level of fog in black and white photothermographic materials. For example, comparing compound 4 with Compound A, it is apparent that the latter compound only reduces the level of fog to about half to one third that obtained when no antifoggant is present, which at 0.25 to 0.4 is not an acceptable value for phothermographic media.

The pre and post-imaging stability of samples of the photothermographic materials prepared in accordance with the invention was then compared with the material containing mercuric bromide. The results are shown in TABLE 5.

TABLE 5

| | | Dmin | | | | |
|---|---|---|---|---|---|---|
| Element | Compound | I | II | IIIa | IIIb | IIIc |
| 10(c) | $HgBr_2$ | 0.14 | 0.12 | 0.14 | 0.16* | 0.17** |
| 11 | 4 | 0.12 | 0.15 | 0.12 | 0.13* | 0.17** |
| 12 | 6 | 0.12 | 0.17 | 0.12 | 0.15 | 0.17 |
| 13 | 7 | 0.13 | 0.12 | 0.13 | 0.16 | 0.17 |
| 14 | 9 | 0.12 | 0.11 | 0.12 | 0.16 | 0.17 |
| 15 | 15 | 0.12 | 0.10 | 0.12 | 0.12 | 0.13 |

(c) = comparative element not in accordance with the invention
I = Initial Dmin after processing at 121° C. (250° F.) for 6 seconds.
II = Dmin of processed material following storage at 49° C. (120° F.) and 50% relative humidity.
IIIa = Light stabilisation = initial value
IIIb = Light stabilisation = after 5 days * after 6 days
IIIc = Light stabilisation = after 12 days ** after 19 days The above results indicate that the use of compounds of formula (I) may confer some degree of pre and post-image stabilisation on the media.

"NONOX" and "VAGH" (Union Carbide), "9022" and "9718" (Humko) and "BUTVAR" (Monsanto) are all trade names/designations.

We claim:

1. A photothermographic material having a photosensitive medium comprising: photosensitive silver halide, a reducible silver source, a reducing agent for silver ion, a hydrobromic acid salt of a nitrogen-containing heterocyclic ring or fused ring nucleus associated with a pair of bromine atoms and, as an antifoggant, in the absence of an antifoggant effective amount of mercury and other heavy metal salts, a tribromomethyl ketone compound of formula (I):

(I)

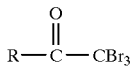

wherein;

R is a member of the group selected from an alkyl group, an aryl group, a carbocyclic ring or a heterocyclic ring.

2. A photothermographic material according to claim 1 wherein R is a member of the group selected from an alkyl group comprising up to 10 carbon atoms, an aryl group comprising up to 14 carbon atoms, a 5, 6, 7 or 8-membered carbocyclic ring nucleus, a carbocyclic fused ring nucleus comprising up to 14 carbon atoms, a 5, 6, 7 or 8-membered heterocyclic ring nucleus or a heterocyclic fused ring nucleus comprising up to 14 ring atoms, and wherein R may possess one or more substituents which are members of the group selected from an alkyl group, halogen atoms, a hydroxy group, alkoxy group, aryloxy group, amino group, a cyano group, acylamino group, diacylamino group, ureido group, sulphonamido group, acyloxy group, sulphamoyl group, alkylcarbonyl group, aryl carbonyl group, alkoxycarbonyl group, aryloxycarbonyl group, alkoxycarbonyl amino group, carbamoyl group, aryl group, hydroxyalkyl group, alkoxyalkyl group, mercapto group, alkylthio group, arylthio group, alkylsulphonyl group, arylsulphonyl group, acyl group, aralkyl group and alkylcarboxylic acid group, wherein each of said groups, comprise up to 14 carbon atoms.

3. A photothermographic material according to claim 1 wherein said antifoggant of formula (I) comprises a nucleus which is a member selected from the group consisting of formulae (II), (III), (IV) and (V):

(II)

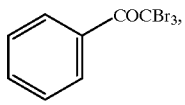

(III)

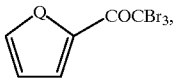

(IV)

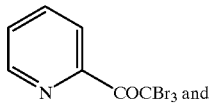

(V)

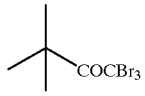

wherein;

Q is a member selected from the group consisting of O, S and $NR^1$ wherein $R^1$ is a member selected from the group consisting of hydrogen and an alkyl group comprising up to 5 carbon atoms.

4. A photothermographic material according to claim 1 wherein the antifoggant comprises a nucleus which is a member selected from the group consisting of:

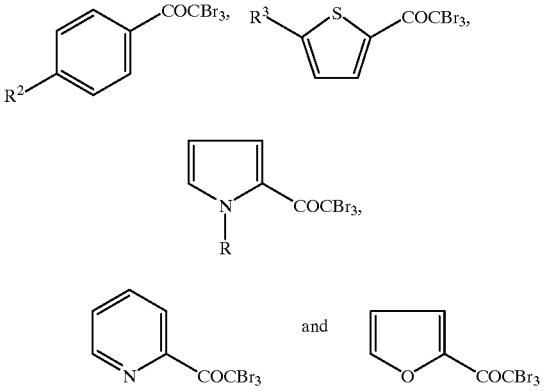

wherein;

$R^2$ is a member selected from the group consisting of hydrogen, an alkyl group, an alkoxy group, a cyano group, an aryl group, and R—C(O)—$CX_3$ wherein X is halogen;

$R^3$ is a member selected from the group consisting of hydrogen, halogen, and a cyano group, and $R^4$ is a member selected from the groups consisting of hydrogen, and an alkyl group.

5. A photothermographic material according to claim 4 wherein $R^2$ is a member selected from the group consisting of —H, —$OCH_3$, —$NO_2$ —CN, —C(O)$CBr_3$ —$C_6H_5$ and —$C(CH_3)_3$; $R^3$ is a member selected from the group consisting of —H, —Cl, —Br, and —CN, and $R^4$ is a member selected from the groups consisting of H and —$CH_3$.

6. A photothermographic material according to claim 1 wherein said antifoggant is present in an amount from $1\times10^{-3}$ to $1\times10^{-1}$ moles per mole of silver halide.

7. A photothermographic material according to claim 1 wherein said hydrobromic acid salt comprises a compound having a central nucleus which is a member selected from the groups consisting of:

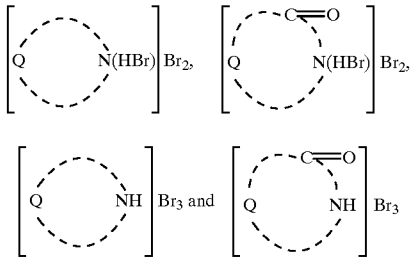

wherein;

Q comprises the atoms necessary to complete a 5, 6, or 7-membered heterocyclic ring nucleus.

8. A photothermographic emultion according to claim 7 wherein Q completes nucleus which is a member selected from the groups consisting of a pyridine, pyrrolidone and pyrrolidinone ring nucleus.

9. A photothermographic material according to claim 7 wherein the hydrobromic acid salt comprises a compound having a central nucleus which is a member selected from the groups consisting of:

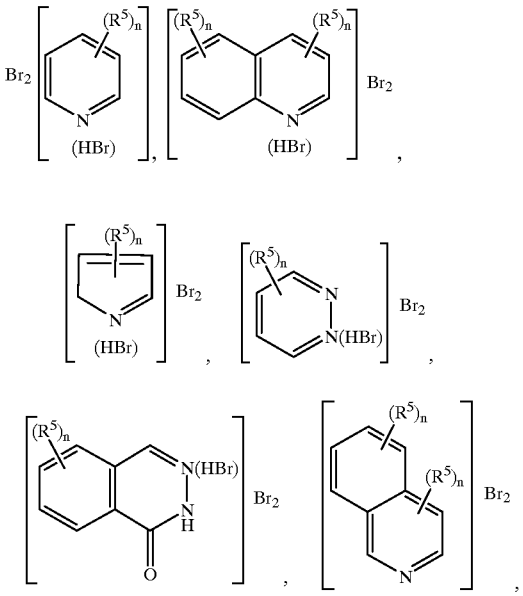

-continued

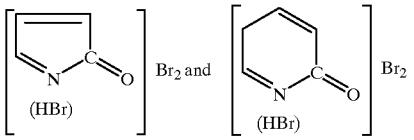

wherein;

n is 0 (zero) or has integral values of from 1 to 4, and each $R^5$ represents a substituent selected from those defined for groups represented by R as defined in claim 1.

10. A photothermographic material according to claim 9 wherein the hydrobromic acid salt is pyridinium hydrobromide perbromide.

11. A photothermographic material according to claim 1 wherein said reducible silver source is selected from a silver salt or complex of an organic or hetero-organic acid.

12. A photothermographic material according to claim 11 wherein said reducible silver source is the silver salt of behenic acid.

13. A photothermographic material according to claim 1 wherein said reducing agent for silver ion is a member selected from the groups consisting of a phenidone, hydroquinone, catechol and a hindered phenol.

14. A photothermographic element according to claim 13 wherein said reducing agent is a hindered phenol having a nucleus of the general formula:

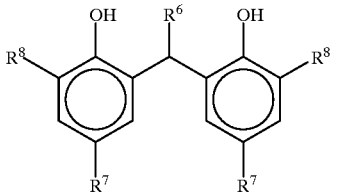

wherein;

$R^6$ is a member selected from the groups consisting of hydrogen and an alkyl group comprising up to 10 carbon atoms, $R^7$ and $R^8$ are independently selected from alkyl groups having 1 to 5 carbon atoms.

15. A photothermographic element according to claim 1 wherein said reducing agent is used in combination with a toner.

16. A photothermographic element according to claim 15 wherein said toner is a member selected from the groups consisting of phthalazinone, phthalazine, phthalic acid and any combination thereof.

* * * * *